US011028838B2

(12) United States Patent
Weckerly et al.

(10) Patent No.: US 11,028,838 B2
(45) Date of Patent: Jun. 8, 2021

(54) INLINE PUMP ASSEMBLY AND METHOD

(71) Applicant: Holley Performance Products, Inc., Bowling Green, KY (US)

(72) Inventors: Shane R. Weckerly, Bowling Green, KY (US); Larry J. Tipton, Bowling Green, KY (US)

(73) Assignee: Holley Performance Products, Inc., Bowling Green, KY (US)

( * ) Notice: Subject to any disclaimer, the term of this patent is extended or adjusted under 35 U.S.C. 154(b) by 41 days.

(21) Appl. No.: 15/881,021

(22) Filed: Jan. 26, 2018

(65) Prior Publication Data

US 2018/0149147 A1 May 31, 2018

Related U.S. Application Data

(60) Division of application No. 14/154,874, filed on Jan. 14, 2014, now Pat. No. 9,879,662, which is a (Continued)

(51) Int. Cl.
*F04B 23/02* (2006.01)
*F04B 23/04* (2006.01)
(Continued)

(52) U.S. Cl.
CPC ..... *F04B 23/02* (2013.01); *F02M 37/18* (2013.01); *F04B 23/04* (2013.01); *F04B 49/03* (2013.01);
(Continued)

(58) Field of Classification Search
CPC .... F04B 23/02; F04B 23/04; Y10T 29/49236; Y10T 137/86163; F02M 37/103
See application file for complete search history.

(56) References Cited

U.S. PATENT DOCUMENTS 2,524,645 A * 10/1950 Abbott ..... F04B 17/046 417/417
4,176,633 A 12/1979 Mccabe
(Continued)

FOREIGN PATENT DOCUMENTS

AU 2002340071 6/2003
AU 340976 2/2012
(Continued)

OTHER PUBLICATIONS

Hwang; PCT International Search Report and Written Opinion for PCT Application No. PCT/US14/71051 dated Mar. 13, 2015.
(Continued)

*Primary Examiner* — Jacob J Cigna
*Assistant Examiner* — Michael W Hotchkiss
(74) *Attorney, Agent, or Firm* — Middleton Readinger

(57) ABSTRACT

A pump assembly and methods of use and conversion including a sealed housing, at least one in-tank, not sealed pump contained in the sealed housing, an outlet check valve inside each pump, and an over pressure relief passage formed around the pumps in the sealed housing. The pump assembly may also include a common fuel inlet, a common fuel outlet; at least two of the pumps, a compact design, a mounting bracket, a sealed electrical inlet, a pre filter, a post filter, a pressure regulator, a returnless fuel supply, a pressure regulator, a return line.

4 Claims, 5 Drawing Sheets

Related U.S. Application Data continuation-in-part of application No. 13/109,588, filed on May 17, 2011, now abandoned, and a continuation-in-part of application No. 13/109,574, filed on May 17, 2011, now abandoned.

(51) Int. Cl.

| | |
|---|---|
| ***F02M 37/18*** | (2006.01) |
| ***F04B 53/16*** | (2006.01) |
| ***F04B 49/03*** | (2006.01) |
| ***F04B 49/10*** | (2006.01) |

(52) U.S. Cl.

CPC ..... *F04B 49/10* (2013.01); *F04B 53/16* (2013.01); *Y10T 29/49236* (2015.01); *Y10T 29/49238* (2015.01)

(56) References Cited

U.S. PATENT DOCUMENTS

| | | | | |
|---|---|---|---|---|
| 4,193,947 | A | 3/1980 | Bugamelli | |
| 4,225,536 | A | 9/1980 | Dougherty et al. | |
| 4,246,929 | A | 1/1981 | Wakeman | |
| 4,283,353 | A | 8/1981 | Miller | |
| 4,336,002 | A | 6/1982 | Rose et al. | |
| 4,798,190 | A | 1/1989 | Vaznaian et al. | |
| 4,864,815 | A | 9/1989 | Cygnor | |
| 4,915,593 | A | 4/1990 | Cygnor | |
| 5,009,390 | A | 4/1991 | Mcauliffe, Jr. et al. | |
| 5,091,858 | A | 2/1992 | Paielli | |
| 5,111,793 | A | 5/1992 | Deeds | |
| 5,123,436 | A | 6/1992 | Koechlein et al. | |
| 5,186,147 | A | 2/1993 | Bellis | |
| 5,257,916 | A * | 11/1993 | Tuckey | F02M 37/048 415/55.2 |
| 5,564,396 | A * | 10/1996 | Kleppner | B01D 35/027 123/509 |
| 5,593,287 | A * | 1/1997 | Sadakata | F02M 37/08 123/509 |
| 5,631,445 | A | 5/1997 | Herster | |
| 5,865,157 | A | 2/1999 | Romanelli et al. | |
| 5,887,569 | A | 3/1999 | Romanelli et al. | |
| 5,904,130 | A | 5/1999 | Romanelli | |
| 6,014,957 | A | 1/2000 | Robinson | |
| 6,106,244 | A | 8/2000 | Nakatsukasa et al. | |
| 6,119,670 | A | 9/2000 | Lavi | |
| 6,158,975 | A * | 12/2000 | Dill | F02M 37/08 123/509 |
| 6,253,735 | B1 * | 7/2001 | Miyajima | F02M 37/0052 123/179.17 |
| 6,360,722 | B1 * | 3/2002 | Onishi | F02M 55/00 123/446 |
| 6,371,153 | B1 | 4/2002 | Fischerkeller et al. | |
| 6,378,512 | B1 | 4/2002 | Staggemeier | |
| 6,527,603 | B1 * | 3/2003 | Wickman | B63H 21/38 123/509 |
| 6,532,941 | B2 | 3/2003 | Begley et al. | |
| 6,536,415 | B2 | 3/2003 | Joos et al. | |
| 6,708,673 | B2 | 3/2004 | Herzog et al. | |
| 6,792,915 | B2 * | 9/2004 | Rembold | F02M 37/0052 123/446 |
| 6,792,918 | B1 | 9/2004 | Halsall | |
| 6,837,228 | B2 | 1/2005 | Baasch et al. | |
| 6,901,888 | B2 | 6/2005 | Baasch et al. | |
| 6,913,210 | B2 | 7/2005 | Baasch et al. | |
| 6,997,401 | B2 | 2/2006 | Baasch et al. | |
| 7,066,155 | B2 | 6/2006 | Uhde et al. | |
| 7,112,110 | B1 * | 9/2006 | Kollmann | F02M 37/0088 440/88 F |
| 7,114,490 | B2 * | 10/2006 | Zdroik | B01D 35/0273 123/497 |
| 7,121,266 | B2 | 10/2006 | Powell | |
| 7,513,243 | B2 * | 4/2009 | Nakagawa | B01D 35/027 123/509 |
| 7,552,720 | B2 | 6/2009 | Borg et al. | |
| 7,631,634 | B2 | 12/2009 | Ramamurthy et al. | |
| D645,055 | S | 9/2011 | Benoit | |
| D645,057 | S | 9/2011 | Benoit | |
| D649,979 | S | 12/2011 | Gieske et al. | |
| D653,263 | S | 1/2012 | Gieske et al. | |
| D659,164 | S | 5/2012 | Tomlinson et al. | |
| 8,302,582 | B2 * | 11/2012 | Oohashi | F02M 37/0029 123/446 |
| D677,755 | S | 3/2013 | Tipton et al. | |
| D696,300 | S | 12/2013 | Arotzarena et al. | |
| 8,683,981 | B2 * | 4/2014 | Uryu | F02D 41/3082 123/456 |
| 9,212,642 | B2 | 12/2015 | Petersen | |
| 9,316,187 | B2 * | 4/2016 | Saler | F02M 37/0052 |
| 9,695,791 | B2 * | 7/2017 | Akimoto | F02M 37/08 |
| 9,796,259 | B2 | 10/2017 | Tipton | |
| D807,922 | S | 1/2018 | Tipton | |
| 9,879,662 | B2 * | 1/2018 | Weckerly | F04B 49/03 |
| 10,029,561 | B2 | 7/2018 | Tipton et al. | |
| 10,260,444 | B2 * | 4/2019 | Wakeman | F02D 41/3836 |
| 2003/0183205 | A1 * | 10/2003 | Mudway | F02M 37/18 123/497 |
| 2004/0219029 | A1 * | 11/2004 | Kleppner | B60K 15/077 417/77 |
| 2005/0205065 | A1 * | 9/2005 | Rembold | F02M 63/0036 123/446 |
| 2006/0065246 | A1 * | 3/2006 | Zdroik | F02M 37/18 123/497 |
| 2008/0236550 | A1 * | 10/2008 | Kobayashi | F02M 37/0052 123/514 |
| 2009/0145402 | A1 * | 6/2009 | Sano | F02M 37/0029 123/447 |
| 2010/0242923 | A1 | 9/2010 | Okada et al. | |
| 2011/0011373 | A1 * | 1/2011 | Shimura | F02M 37/0029 123/497 |
| 2012/0294731 | A1 * | 11/2012 | Weckerly | F04B 23/04 417/53 |
| 2012/0294732 | A1 | 11/2012 | Weckerly et al. | |
| 2012/2001238 | | 12/2012 | Weckerly et al. | |
| 2015/0114347 | A1 | 4/2015 | Hudnall et al. | |
| 2017/0166045 | A1 * | 6/2017 | Tipton | F02M 37/103 |
| 2018/0037106 | A1 | 2/2018 | Tipton | |
| 2018/0149147 | A1 | 5/2018 | Weckerly et al. | |
| 2018/0290539 | A1 | 10/2018 | Tipton et al. | |

FOREIGN PATENT DOCUMENTS

| | | |
|---|---|---|
| AU | 340977 | 2/2012 |
| AU | 340978 | 2/2012 |
| AU | 201616189 | 12/2016 |
| AU | 2017200254 | 7/2019 |
| AU | 2014377624 | 8/2019 |
| CA | 2832503 | 5/2014 |
| CN | 108366683 | 8/2018 |
| DE | 10393644 | 12/2005 |
| GB | 2409239 | 6/2005 |
| JP | 11173228 | 6/1999 |
| KR | 1020020083293 | 11/2002 |
| WO | 2015108657 | 7/2015 |
| WO | 2017106331 | 6/2017 |

OTHER PUBLICATIONS

Painless Products "Perfect Flow Fuel Delivery System" Installation Instruction Manual, May 2010.

Painless Products "Perfect Flow Fuel Delivery System" product page, part No. 65100, downloaded from the Painless Performance Products website, http://painlessperformance.com/webcatalog.

Schultz, Mort, "Car Clinic Solutions for Mechanical Headaches," Popular Mechanics, May 1982, p. 42.

Australian Patent Application No. 2014377624 Examination Report No. 1 dated Feb. 9, 2018.

Australian Patent Application No. 2014377624 Notice of Acceptance dated Jan. 17, 2019.

Australian Divisional Patent Application No. 2017200253 Examination Report No. 1 dated May 4, 2018.

(56) References Cited

OTHER PUBLICATIONS

Australian Divisional Patent Application No. 2017200254 Examination Report No. 1 dated Apr. 17, 2018.
Australian Divisional Patent Application No. 2017200254 Examination Report No. 2 dated Jan. 31, 2019.
Australian Patent Application No. 2017200254 Notice of Acceptance dated Mar. 25, 2019.
Australian Patent Application No. 2019203171 entitled "Pump System and Method of Use" filed May 6, 2019.
IP Australia, Examination report No. 1 for application No. 2019203171 dated May 14, 2020.

* cited by examiner

INLINE PUMP ASSEMBLY AND METHOD

CLAIM TO PRIORITY

This divisional patent application claims priority to and benefit of, under 35 USC § 121, to U.S. patent application Ser. No. 14/154,874, filed Jan. 14, 2014, titled "Inline Pump Assembly and Method" which is a continuation-in-part to U.S. patent application Ser. No. 13/109,588, filed May 17, 2011, now abandoned, titled "Pump System and Method of Use", and is also a continuation-in-part to U.S. patent application Ser. No. 13/109,574, filed May 17, 2011, now abandoned, titled "Pump System and Method of Use", all of which is expressly incorporated herein by reference.

BACKGROUND OF THE INVENTION

Field of the Invention

The inventions disclosed and taught herein relate generally to devices pumps, and more specifically relate to high flow fuel pumps.

Description of the Related Art

The performance market has a segment that requires very high flow fuel pumps to supply the demands of large horsepower engines. The pumps are generally limited to these unique race engines. They contain warnings concerning their use for off-track applications due to the high current and flow recirculation requirements.

Generally, electric fuel pump designs match the peak torque of the motor performance curve with the pumping element to achieve the desired flow at a pressure point. As a result, the current suppliers develop multiple pumps to address some of the known requirements in the market by grouping their product into horsepower rating brackets.

This grouping is convenient for the supplier but can complicate the fuel management for the engine builder. If the horsepower is lower than the known bracket, the user would be forced to choose a higher flow pump and try to manage a high return flow. High return flows can result in overheating of the fuel, loss of pressure, and potential damage to the pump, especially in high performance street car applications. If the horsepower were higher than the known brackets, the user would be forced to try to stretch the pump flow by increasing the pump voltage, which then increases the flow. This option is not preferable to the pump supplier because these variables are not recognized in the pump development and pose a risk of inconsistent performance or pump damage.

Currently, this need is met with very large and very expensive self-sealed electric fuel pumps. These pumps require extensive investment dollars and development time to provide a reliable product. Therefore, a need exists to find a faster, less expensive and more reliable approach that offers full-race performance and off-track use.

Additionally, some devices consist of self-sealed pumps. These devices are significantly larger and heavier than is desired in all situations. These devices typically require disassembly to attach a wire harness and mount the assembly. Additionally, devices of this nature have a significant number of joints. Joints can potentially leak. Moreover, devices with self-sealed pumps typically are noisier because the pumps are exposed to the environment and are a solid mount to the inlet and outlet housings. There exists a need to provide an assembly that can contain more than one pump in a smaller and lighter configuration. There also exists a need to provide a less expensive and less complex configuration for this purpose. There also exists a need to offer a more convenient wiring solution. There also exists a need to reduce the number of joints to offer less potential leak exposure. Additionally, there exists a need to contain pumps that are not sealed so as to reduce noise. Unsealed pumps are typically used inside of a fuel tank where slight leaking around some crimped or staked assembly features is acceptable. However, they are less acceptable for external, in-line use. Finally, there exists a need to provide pumps that are not sealed that may be suspended inside a sealed housing in a manner that reduces or eliminates metal-to-metal connections.

BRIEF SUMMARY OF THE INVENTION

The inventions disclosed and taught herein are directed to multiple fuel pumps that have been fully developed and endurance tested in the original equipment automotive industry. By matching the engine builder's pump flow and pressure requirement by grouping existing pumps into one assembly with a common inlet and outlet, this grouping could include at least one pump, preferably two, three, or four pumps, depending on the unique requirements. Additionally, the present invention can sequence the pumps individually to stage the current draw and dramatically reduce the return flow to the tank. This will reduce the heat buildup in the fuel, which reduces the opportunity for vapor lock and potential pump damage to occur.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
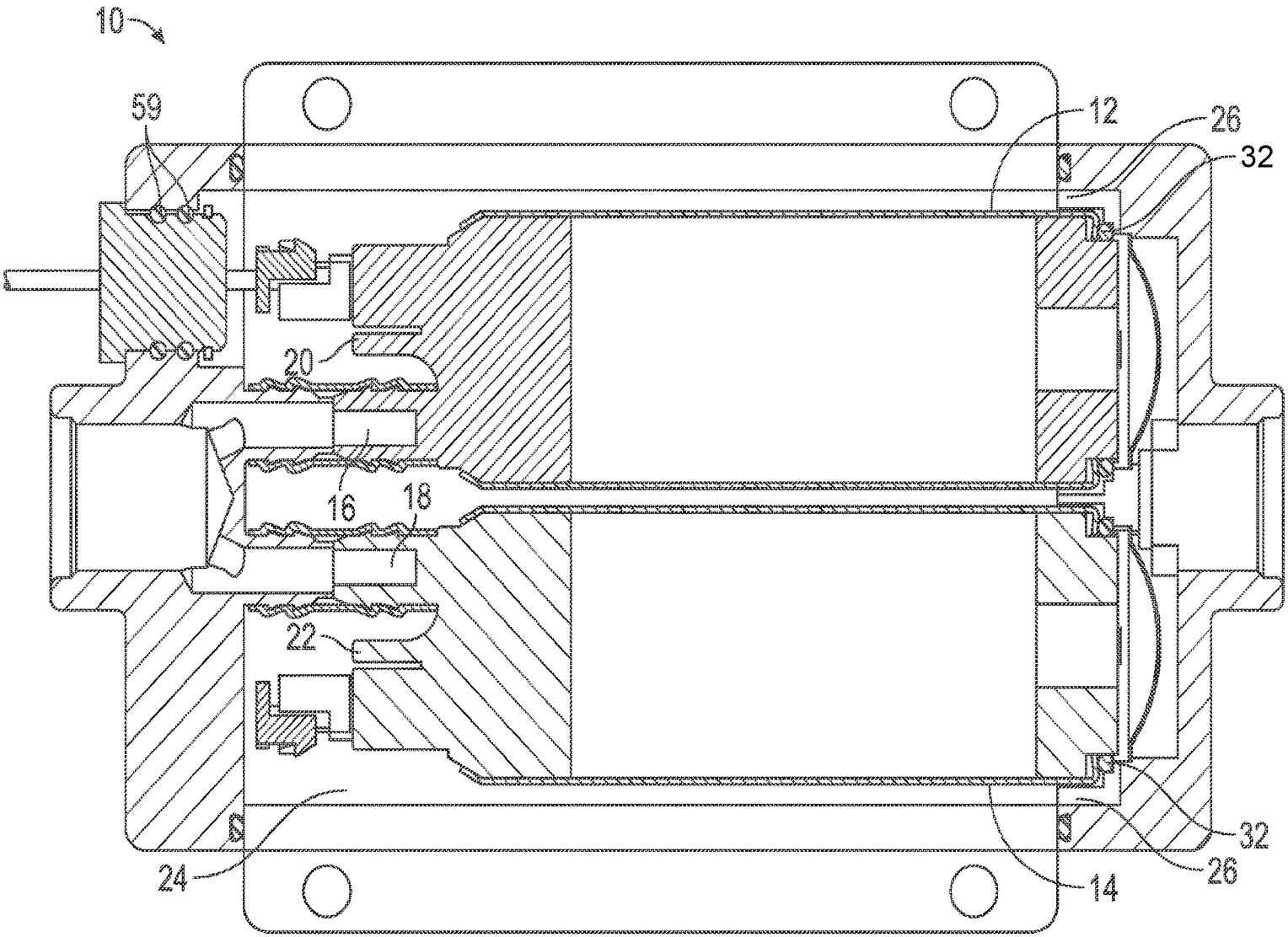
FIG. 1 illustrates a cross-sectional, partial side view of an embodiment of the invention.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION OF THE INVENTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Applicants have created a device capable of providing a sealed housing, which contains at least one fuel pump that is not sealed. This invention may include matching or mixing pumps to meet the specifications and needs of the engine. Moreover, this invention offers the advantage of sealed electrical, fuel inlet, and fuel outlet connections. This arrangement may also allow for options for controlling the pumps individually based on various input choices. Additionally, this invention offers the option for integrating a pressure regulator, a pre filter, and/or a post filter for complete fuel system management.

A pump assembly and methods of use and conversion including a sealed housing, at least one in-tank, not sealed pump contained in the sealed housing, an outlet check valve inside each pump, and an over pressure relief passage formed around the pumps in the sealed housing. The pump assembly may also include a common fuel inlet, a common fuel outlet; at least two of the pumps, a compact design, a mounting bracket, a sealed electrical inlet, a pre filter, a post filter, a pressure regulator, a returnless fuel supply, a pressure regulator, a return line.

Turning now to the figures, FIG. 1 illustrates an exemplary two-pump configuration in accordance with aspects of the present invention. In this embodiment, two pumps 12 and 14 that are not sealed are shown arranged side-by-side within a common sealed housing 10. Those skilled in the art will recognize that the design of the common sealed housing 10 is a compact design that is cosmetically pleasing and suitable for show, race, street, marine, and similar applications. These pumps 12 and 14 may operate singly, or simultaneously so as to provide the specified flow of fluid during engine operation.

Those skilled in the art will recognize that pumps 12 and 14 may be matched in performance levels, or be different in performance levels. This allows for the pairing of flow and pressure options to permit a more accurate matching to the engine builder's specifications. The result is an optimized pump performance for current, pressure, and flow. Each pump 12 and 14 has an outlet check valve 16 and 18, respectively, to hold fuel pressure when the voltage is not applied or when they are turned off.

Moreover, the pumps 12 and 14 also have over pressure relief valves 20 and 22, respectively. In the unlikely event of a system blockage while the pumps 12 and 14 are energized, the over pressure relief valves 20 or 22 will open at safe pressure above system pressure. The fuel will be discharged into the cavity 24 around the pumps 12 and 14, respectively. This fuel can then pass around the housing inlet O-ring cushions 32 through slots 26 provided within the sealed housing and recirculate back to the inlets of the pumps 12 and 14. This prevents pump damage and excessive system pressure that could result in a major fuel leak.

Figure 2:
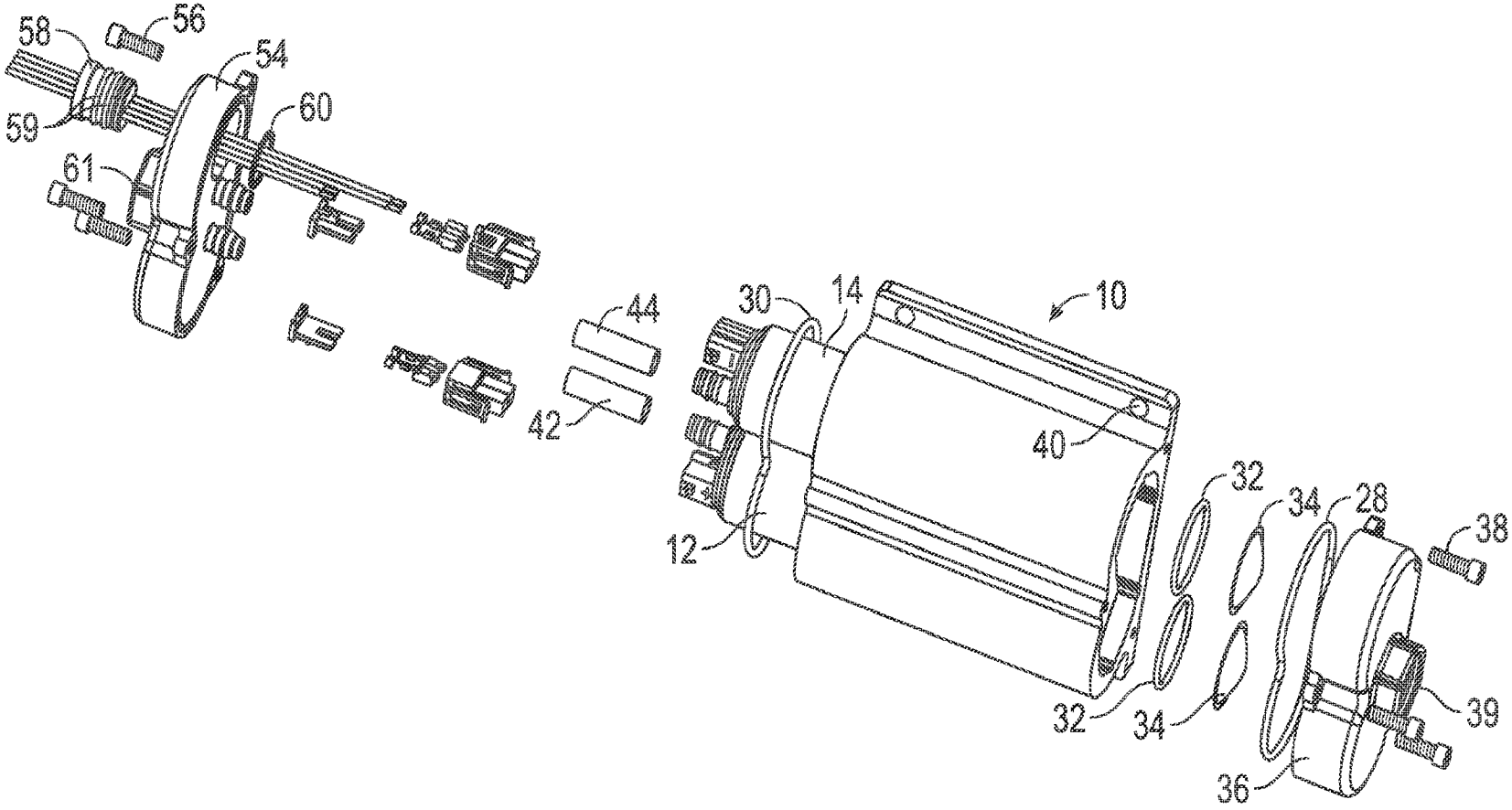
FIG. 2 illustrates an exploded view of an embodiment of the invention.

FIG. 2 illustrates an exploded view of the sealed housing 10 for the fuel pumps. Pumps 12 and 14 are shown in relation to the sealed housing 10 and associated seals which make up the assembly of the present disclosure. The housing inlet O-ring seal 28 and housing outlet O-ring seal 30 allow for the sealing of the pumps 12 and 14 inside the sealed housing 10, which is preferably made of an appropriate metal (e.g., aluminum, steel, or metal alloys), although any other suitable material, such as carbon fiber or suitable polymeric materials as appropriate.

The pumps 12 and 14 are shown with pump O-rings 32 and inlet strainers 34, respectively after a common fuel inlet 39. The pump O-rings 32 act together to prevent metal-to-metal vibration noise during operation of the pump assembly, although common inlets and outlets are a preferred embodiment, and not mandatory. Common inlets and outlets simplify installation, provide lower costs than separate lines and fittings, and allow replacing old style, single pumps systems without additional work or expense.

Moreover, the pumps 12 and 14 are fitted at one end into inlet housing 36, which may be held in place by fasteners 38. In a preferred embodiment, the fasteners 38 are assembly screws, although any other suitable attachment means may be used. The sealed housing 10 also preferably includes mounting holes in a mounting bracket 40 to allow for the assembled sealed housing 10 to be mounted onto the vehicle or other application.

Turning to the outlet end of the pumps 12 and 14, fuel tubes 42 and 44 connect and seal pumps 12 and 14 to the pump outlet, respectively, to form a common fuel outlet connection. An outlet housing 54 is shown expanded above the fuel tubes 42 that may be held in place by fasteners 56. In a preferred embodiment, the fasteners 56 are assembly screws, although any other appropriate attachment means may be used for securing the outlet housing 54 to the sealed housing 10, as appropriate. A common fuel outlet 61 connects to fuel tubes 42 and 44.

The pump outlet preferably contains the check valve to hold the system pressure when the engine is off. The pump outlet must not leak compared to other portions of the pump housing, wherein leaking is more preferable.

As also illustrated in FIG. 2, a sealed electrical inlet 58 is included to seal wires that pass through and connect to the pumps 12 and 14. This sealed electrical inlet 58 may be held in place by a retainer ring 60 or other suitable retaining means. Those skilled in the art will recognize that any number of wires or similar means may be connected to the pumps 12 and 14 via this sealed electrical inlet 58. O-rings 59 may be included as appropriate so as to seal the sealed electrical inlet 58 within the mounting hole of housing 54.

Figure 3:
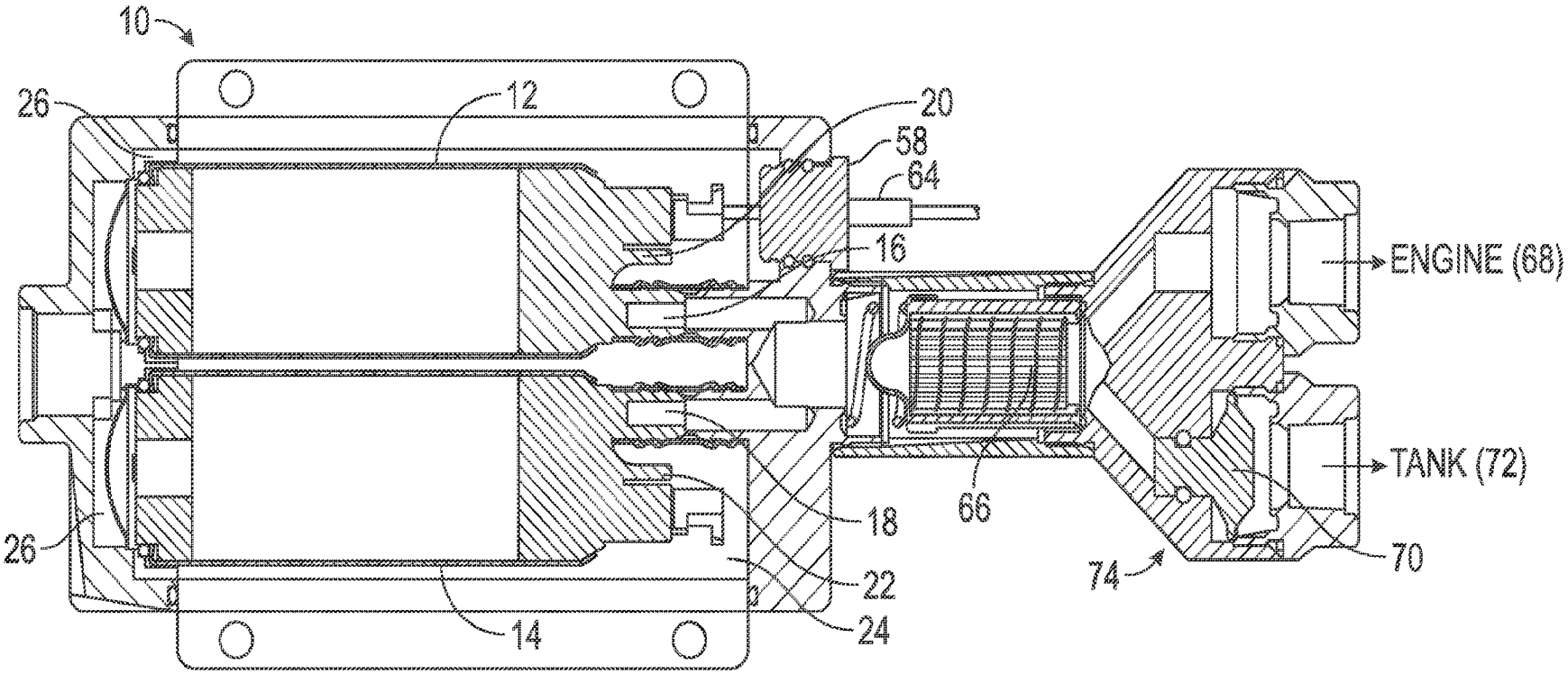
FIG. 3 illustrates a cross-sectional, partial side view of an application of an embodiment of the invention.

FIG. 3 illustrates a cross-sectional view a preferred embodiment of the present disclosure in a representative configuration. In this embodiment, the sealed housing 10 is shown such that pumps 12 and 14 are positioned in a typical operational orientation. The area around the pumps 12 and 14 illustrates the over pressure relief passage or slots 26 that may be used to return fuel to the pump inlets when either of the over pressure relief valves 20, 22 are actuated by excessive pressure within one or both of the pumps 12, 14.

The sealed electrical inlet 58 acts to seal wires 64 that pass through and connect to the pumps 12 and 14, powering the pumps. The outlets of pumps 12 and 14 are connected via a post filter 66 to engine 68.

An alternative embodiment includes operating the pumps independently with an electronic controller. This could be activated by staging their operation based on engine RPM, air flow, fuel flow, throttle position, boost, or pressure drop as examples of trigger signals. Another alternative embodiment would be the use of this invention in a multiple carburetor application.

Another embodiment, illustrated in FIG. 3, includes incorporating the post filter 66 and pressure regulator 70 into a regulator housing 74 to form a returnless fuel supply such that fuel is returned to the tank 72 via the regulator 70. This embodiment reduces the potential for heating the fuel by returning it to the tank from the pump assembly instead of the engine fuel rail. Another embodiment includes integrating the post filter 66 option only.

Figure 4:
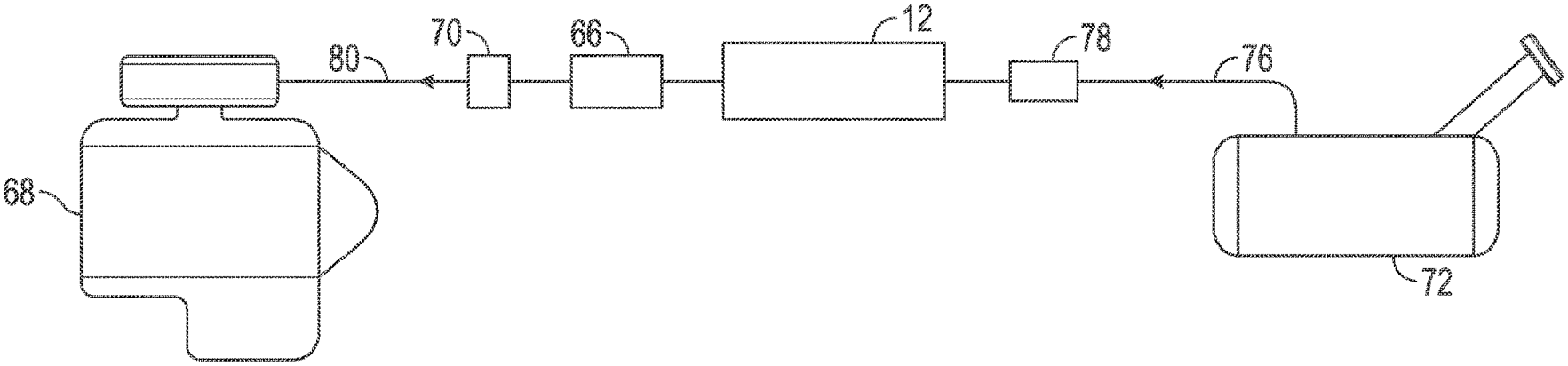
FIG. 4 illustrates a side view of an embodiment of the invention in carbureted fuel system.

Another embodiment is shown in FIG. 4. This embodiment shows an example of using the invention in a carbureted fuel system with a demand style regulator 70. As shown, the fuel tank 72 is connected to the pre filter 78 via a supply line 76.

The pre filter 78 may be of any in a preferred embodiment, the pre filter 78 size may be of any appropriate size known to those skilled in the art. In a preferred embodiment, a 100 micron filter size is useful.

The fuel travels from the pre filter 78 to the pump or pumps 12, depending on the number of pumps present in the sealed housing 10. Exiting from the pump 12, the fuel may pass through a post filter 66 and through a demand style pressure regulator 70. The post filter 66 may be of any appropriate size known to those skilled in the art. In a preferred embodiment, a 40 micron filter size is useful. After the pressure regulator 70, the fuel may pass to the engine 68 via a pressure fuel line 80.

Figure 5:
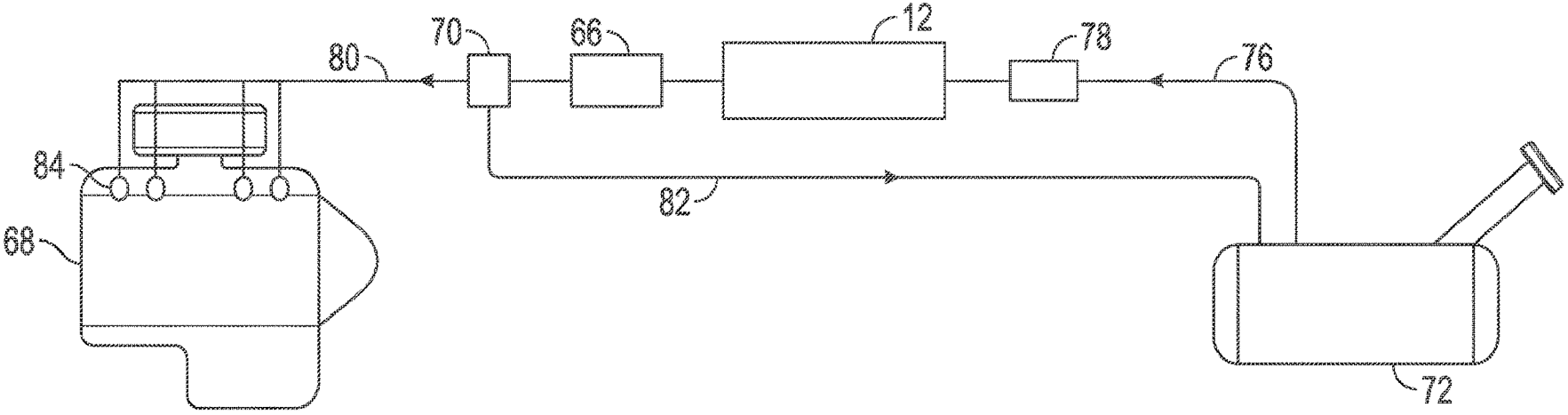
FIG. 5 illustrates a side view of an embodiment of the invention in a fuel injection system.

FIG. 5 shows another embodiment preferable for use in fuel injection systems with a bypass pressure regulator 70. In this embodiment, fuel passes from the fuel tank 72 via the supply line 76 to the pre filter 78. The fuel then passes into the pump or pumps 12 and then through a post filter 66.

Those skilled in the art will recognize that many sizes of filters are useful for both the pre filter 78 and the post filter 66 in this configuration. In a preferred embodiment, a 100 micro pre filter 78 and a 10 micron post filter 66 are used.

After the post filter 66, the fuel travels to a bypass style pressure regulator 70. At this point, the fuel can either travel through the high pressure fuel line 80 to the engine 68 via fuel injectors 84 or the fuel can be returned via the return line 82.

The demand style pressure regulator 70 usually operates between about 3 and about 12 PSI. This demand style pressure regulator 70 typically requires that the relief valve to function almost continually compared to the bypass style pressure regulator 70, which usually operates between about 40 and about 72 PSI. The bypass style pressure regulator 70 typically only operates as a fail-safe pressure relief valve.

The demand over pressure relief valves 20, 22 could operate continuously since their function is to constantly produce pressure above the regulator set pressure so the pressure regulator 70 can control the pressure to the carburetors. For example, the idle fuel flow will be the smallest amount but the pumps 12, 14 are constantly producing flow at the maximum performance, without some kind of electronic speed control. The bulk of the fuel will be returned to the inlet 39. As the engine demand for fuel increases to the maximum, the return flow to the pump inlet 39 will be reduced proportionately.

Further, the various methods and embodiments of the invention can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

The invention claimed is:

1. A method of making a pump assembly comprising: placing two in-tank, not sealed pumps into a common sealed housing, said common sealed housing contains the only two pumps in a fuel system wherein each pump has an over-pressure relief valve; forming an over pressure relief passage formed around the two in-tank, not sealed pumps in the common sealed housing, wherein said over pressure relief valves are in flow communication with said over relief passage; and forming a common fuel inlet in the common sealed housing; forming a common fuel outlet in the common sealed housing; providing a post filter on an outlet side of the two in-tank, not sealed pumps and directly connected to said common sealed housing; wherein the common sealed housing is configured to be remotely positioned from a fuel tank.

2. The method of claim 1 further comprising:

forming a mounting bracket in the common sealed housing; and forming a sealed electrical inlet in the common sealed housing.

3. The method of claim 1 further comprising: installing a pre filter; and installing a pressure regulator in the common sealed housing to form a returnless fuel supply.

4. The method of claim 1 further comprising:

installing a pressure regulator; and installing a return line;

wherein the return line is connected to the pressure regulator and is capable of being connected to the fuel tank.

* * * * *